US007344322B2

(12) United States Patent
Hayashi et al.

(10) Patent No.: US 7,344,322 B2
(45) Date of Patent: Mar. 18, 2008

(54) DRYING DEVICE AND DRYING METHOD

(75) Inventors: Kenji Hayashi, Shizuoka-ken (JP); Manabu Hashigaya, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 41 days.

(21) Appl. No.: 11/041,970

(22) Filed: Jan. 26, 2005

(65) Prior Publication Data

US 2005/0163502 A1 Jul. 28, 2005

(30) Foreign Application Priority Data

Jan. 27, 2004 (JP) ..... 2004-018181

(51) Int. Cl.
*G03D 13/00* (2006.01)

(52) U.S. Cl. ..... 396/571; 396/572; 355/27

(58) Field of Classification Search ..... 396/571, 396/572

See application file for complete search history.

(56) References Cited

U.S. PATENT DOCUMENTS 4,263,500 A * 4/1981 Springer et al. ..... 392/410
4,588,923 A * 5/1986 Hoegler et al. ..... 313/579
4,668,073 A * 5/1987 Hatabe et al. ..... 399/156
5,094,010 A * 3/1992 Jacobi et al. ..... 34/278
2004/0211927 A1* 10/2004 Schmidt ..... 250/504 R
2004/0241901 A1* 12/2004 Bar et al. ..... 438/99
2005/0024459 A1* 2/2005 Codos ..... 347/102
2006/0127616 A1* 6/2006 Beck ..... 428/35.7

FOREIGN PATENT DOCUMENTS

JP 2000-35279 A 2/2000
JP 2000-329463 A 11/2000
JP 2002-14461 A 1/2002

* cited by examiner

*Primary Examiner*—D. Rutledge
(74) *Attorney, Agent, or Firm*—Sughrue Mion, PLLC

(57) ABSTRACT

A drying device, which dries a photosensitive layer of a photosensitive planographic printing plate using infrared rays, includes an infrared emitting device and a filter that is arranged between the photosensitive planographic printing plate conveyed through the drying device and the infrared emitting device and that blocks a predetermined range of wavelength. More specifically, the filter is arranged between a web that is conveyed through the drying device and a mid-infrared radiator, so as to block 30% or more of wavelengths of 1 μm or less. As a result, fogging on a photosensitive coating layer can be prevented, and high heating efficiency can be achieved.

18 Claims, 5 Drawing Sheets

DRYING DEVICE AND DRYING METHOD

CROSS-REFERENCE TO RELATED APPLICATION

This application claims priority under 35 USC 119 from Japanese Patent Application No. 2004-018181, the disclosure of which is incorporated by reference herein.

BACKGROUND OF THE INVENTION

1. Field of the Invention

The present invention relates to a drying device and a drying method for drying a photosensitive layer of a photosensitive planographic printing plate using infrared rays.

2. Description of the Related Art

Photosensitive planographic printing plates are produced in the following manner. At least one surface of an aluminum web, which is a belt-shaped aluminum thin plate, is grained, and a photosensitive coating liquid containing photosensitive resin or thermosensitive resin is applied to the surface and is dried to form a photosensitive layer.

For example, in Japanese Patent Application Laid-Open (JP-A) No. 8-296962, as shown in FIG. 4, items to be heated are continuously transported on a conveyor 100 and heated, and far infrared heaters 102 are arranged parallel to and above and below the conveyor 100, so as to prevent temperature variation with respect to the items being heated.

In JP-A No. 2002-14461, as shown in FIG. 5, a far infrared emitting device 106 is arranged downstream of a hot air drying device 104. The far infrared emitting device 106 is composed of a far infrared heater 108 in which ceramic material is used to emit far infrared rays.

The surface temperature of the ceramic material in the far infrared heater 108 is 300° C. or more (λmax: 5.1 μm), at which drying efficiency is superior to that of a hot air system, and not more than 800° C. (λ max: 2.7 μm), which does not include wavelengths of 1 μm or less. The far infrared heater 108 is adapted to heat a photosensitive layer and an aluminum plate 110.

In JP-A No. 2000-329463, the wavelength area range within which a liquid can be dried efficiently is 1 to 30 μm, and a far infrared lamp which emits infrared rays of predominantly 2 to 7 μm is optimal for drying a coating film With infrared rays, heating efficiency is better in a low-wavelength range (not more than 2 μm), however when an aluminum web formed with a photosensitive layer is heated by infrared rays in low-wavelength range (not more than 2 μm) with satisfactory heating efficiency, a photosensitive object on the aluminum web will become fogged. For this reason, the aluminum web is generally heated by far-infrared rays which are not in the low-wavelength range (for example, JP-A No. 2002-14461); however, this deteriorates the heating efficiency.

In JP-A No. 2000-35279, therefore, which discloses only a far infrared drying furnace, it takes time to reduce residual solvent after a coating film is adhered, and thus the drying efficiency is deteriorated. For this reason, a heated roll as well as the far infrared drying furnace is used, and a hot-air furnace is also used, in order to compensate for the deterioration of the heating efficiency due to use of far-infrared rays.

SUMMARY OF THE INVENTION

Taking the above problems into consideration, an object of the present invention is to provide a drying device and a drying method that use infrared rays, have satisfactory heating efficiency, and prevent fogging on a photosensitive layer.

In order to solve the above problems, in a first aspect of the invention, a drying device, which dries a photosensitive layer of a photosensitive planographic printing plate using infrared rays, includes: an infrared emitting device; and a filter that is arranged between the infrared emitting device and the photosensitive planographic printing plate conveyed through the drying device and that blocks a predetermined range of wavelength (note that, in the present invention, a "filter" collectively represents at least one of: an infrared wavelength controlling filter; an infrared wavelength path selecting filter; and a near-infrared wavelength cutting filter.)

According to the first aspect, the filter that blocks a predetermined range of wavelength is arranged between the infrared emitting device and a belt-shaped body. The infrared rays have a wavelength range of about 0.76 μm to 1 mm, and the wavelength range is divided into a near-infrared range (0.76 to 2 μm), a mid-infrared range (2 to 4 μm), and a far-infrared range (4 μm to 1 mm). As the wavelength range becomes shorter, the heating efficiency improves.

When the photosensitive layer on the photosensitive planographic printing plate is dried, if the photosensitive planographic printing plate is heated in the low-wavelength range (near-infrared range) in which the heating efficiency is satisfactory, the photosensitive layer on the photosensitive planographic printing plate becomes fogged. On the other hand, if the photosensitive planographic printing plate is heated in the high-wavelength range (far-infrared range), the heating efficiency is not satisfactory, and production efficiency deteriorates.

According to the first aspect, the use of the filter that blocks a predetermined range of wavelength can, for example, block a wavelength in a range of 1 μm or less from an infrared emitting device having a wavelength range of 2 μm or less. As a result, fogging on the photosensitive layer can be prevented, and high heating efficiency due to the low-wavelength range can be obtained.

In a second aspect of the invention, the wavelength in a range of 1 μm or less is blocked by the filter. According to the second aspect, when the wavelength in a range of 1 μm or less is blocked by the filter, the heating efficiency can be improved within a range where fogging does not occur on the photosensitive layer.

In a third aspect of the invention, the blocking ratio of the wavelength in a range of 1 μm or less by means of the filter is 30% or more in the drying device of the second aspect.

In this aspect, wavelengths of 1 μm or less are blocked by 30% or more. That is to say, the blocking ratio for wavelengths of 1 μm or less is specified, thereby further or more reliably improving the heating efficiency within the range where fogging does not occur on the photosensitive layer.

According to a fourth aspect of the invention, in the drying device according to any of the first to third aspects, the filter is quartz glass.

According to a fifth aspect of the invention, in the drying device according to any of the first to third aspects, the filter is ceramic.

In a sixth aspect of the invention, a drying method for drying a photosensitive layer of a photosensitive planographic printing plate using infrared rays includes drying the photosensitive layer using a drying device in which a filter that blocks a predetermined range of wavelength is arranged between the photosensitive planographic printing plate conveyed through the drying device and an infrared emitting device.

In the sixth aspect, the drying device, in which the filter that blocks a predetermined range of wavelength is arranged between the photosensitive planographic printing plate conveyed through the drying device and the infrared emitting device, dries the photosensitive layer on the photosensitive planographic printing plate. Accordingly, fogging on the photosensitive layer can be prevented, and heating efficiency can be achieved due to a low-wavelength range.

DETAILED DESCRIPTION OF THE INVENTION

Figure 1:
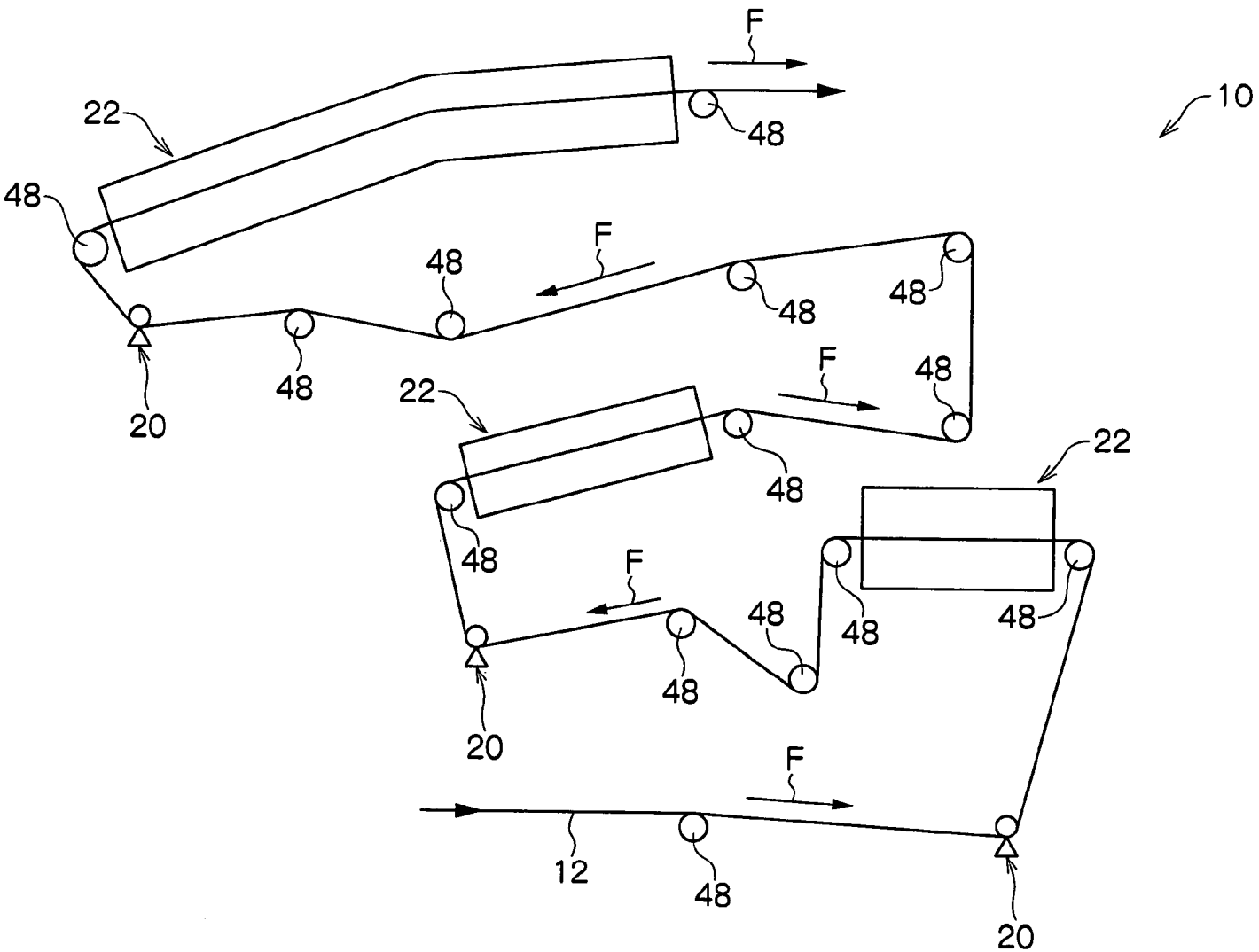
FIG. 1 is a schematic diagram illustrating a production line for a planographic printing plate having a drying device according to an embodiment of the present invention.

FIG. 1 illustrates a part of a production line 10 for a planographic printing plate having a drying device 22 according to an embodiment of the present invention. A feeding apparatus, not shown, is disposed at the upstream end of the production line 10. An aluminum plate web 12 with a thickness of 0.1 to 0.5 mm is wound into a roll shape and fed out from the feeding apparatus at a speed corresponding to the conveyance speed of the production line 10.

A plurality of transport rollers 48 are supported pivotally along the production line 10, which are rotatably driven by a driving motor, not shown, so as to convey the web 12 fed out by the feeding apparatus toward the downstream end of the production line 10.

Examples of the aluminum plate used as material for the web 12 include JIS1050 material, JIS1100 material, JIS1070 material, Al-MG alloys, AL-MN alloys, AL-MN-MG alloys, AL-ZR alloys, and AL-MC-SI alloys.

The process of producing an aluminum plate at a manufacturer involves producing an ingot of aluminum which meets the above standards, hot-rolling the aluminum ingot and subjecting it to a heating process called annealing as the need arises. The aluminum ingot is finished as a belt-shaped aluminum plate with predetermined thickness by cold rolling, and the plate is wound into a roll shape.

On the other hand, the production line 10 is provided with a correcting device (roller leveler, tension leveler, or the like), an upper surface grinding device, a lower surface grinding device, a roughening device, an anodizing device, and the like (none shown). The correcting device improves the flatness of the web 12. The upper surface grinding device and the lower surface grinding device grind the upper surface and the lower surface of the web 12, respectively. The roughening device roughens the surface of the web 12. The anodizing device performs a known anodizing process on the web 12. These devices thus collectively perform the necessary preprocesses for the web 12.

The production line 10 shown in FIG. 1 is disposed downstream of the anodizing device. A plurality of coating devices 20 are provided along the production line 10 in the conveyance direction (the direction of arrow F) of the web 12. The coating devices 20 apply a photosensitive coating liquid to the surface of the web 12, to form a photosensitive coating layer 12A. The photosensitive coating layer 12A is formed by coating with an organic solvent having photosensitive or thermosensitive components dissolved therein.

The coating devices 20 are not particularly limited as long as they meet certain conditions for applying a coating liquid to the web 12. Examples thereof include a roll coater, a gravure coater, a microgravure coater, a bar coater, an extrusion coater, a slide coater, and a curtain coater.

Figure 2:
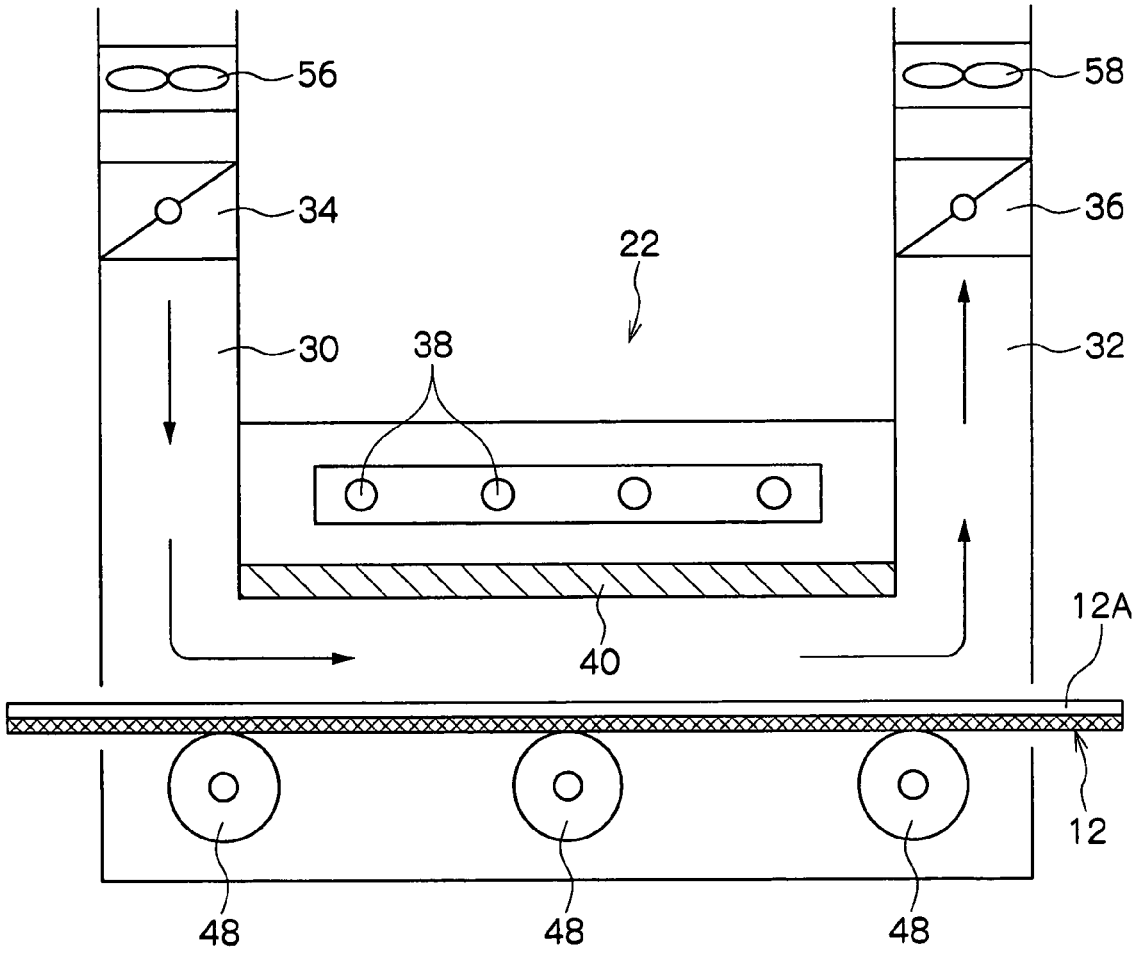
FIG. 2 is a longitudinal sectional view illustrating the drying device according to the embodiment of the invention.
Figure 3:
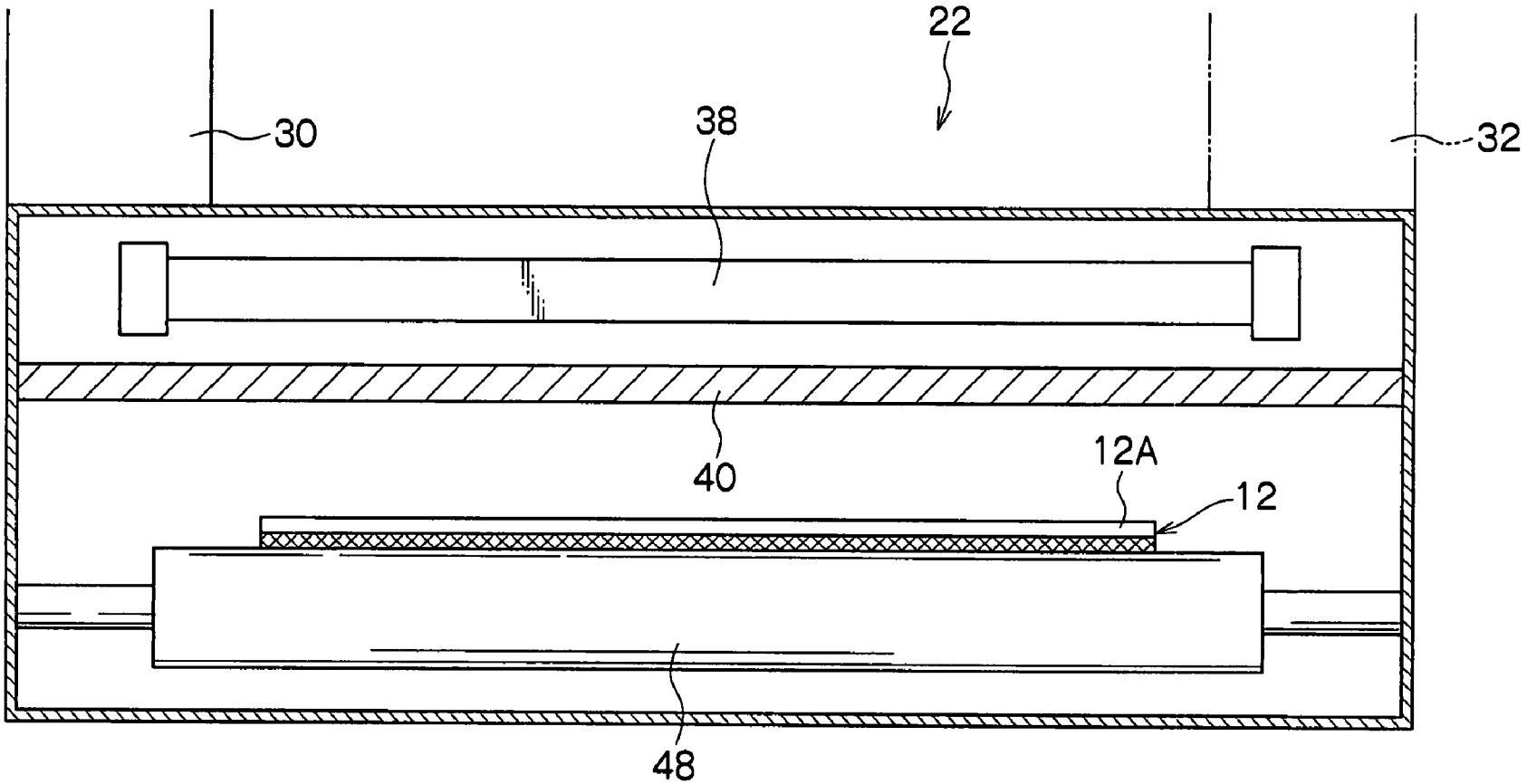
FIG. 3 is a lateral sectional view illustrating the drying device according to the embodiment of the invention.
Figure 4:
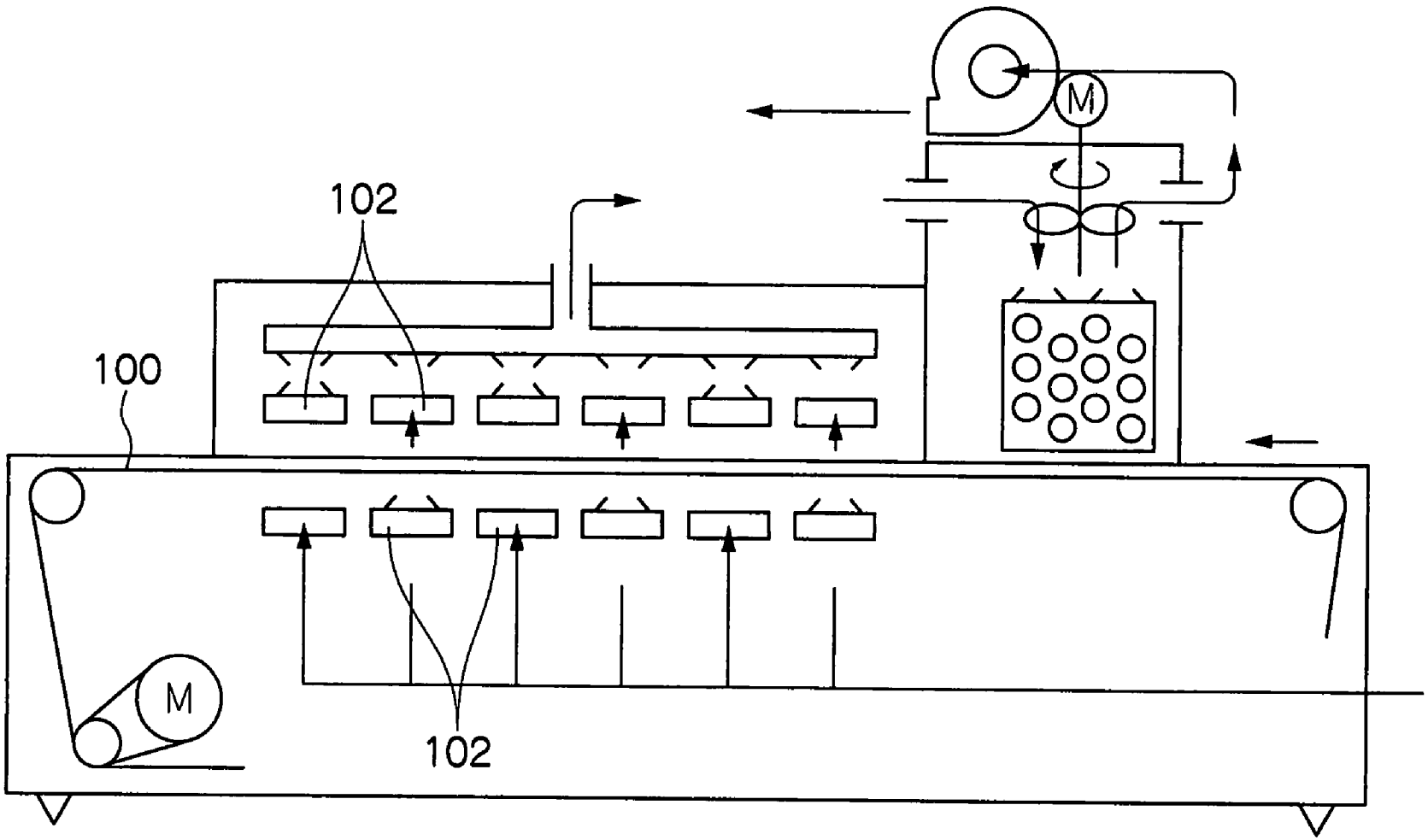
FIG. 4 is a schematic diagram illustrating a conventional drying device (JP-A No. 8-296962).
Figure 5:
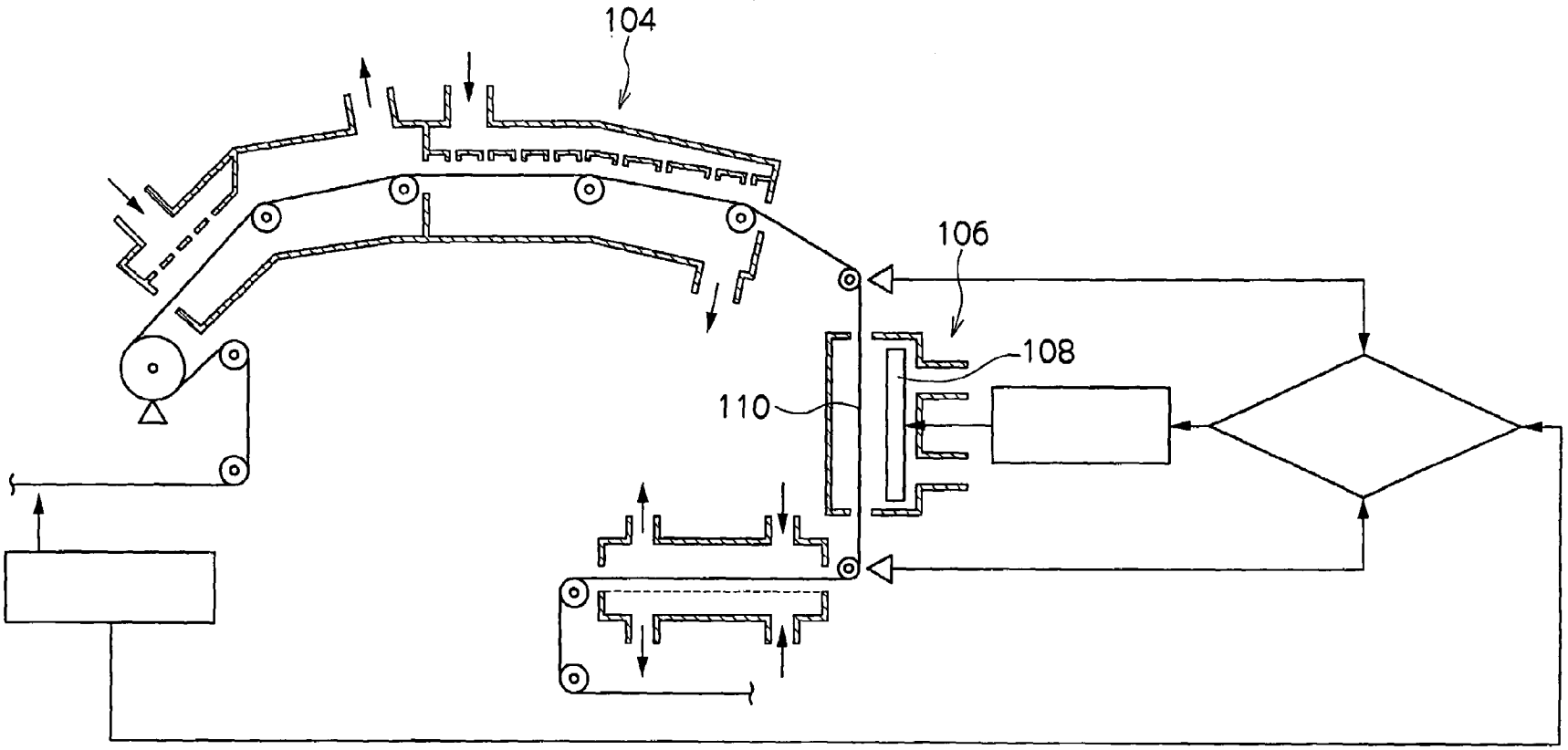
FIG. 5 is a schematic diagram illustrating a conventional drying device (JP-A No. 2002-14461).

Drying devices 22 are provided downstream of the coating devices 20. The drying devices 22 are provided along the conveyance direction of the web 12. Air is sent into the drying devices 22 so that the coating liquid is dried. As shown in FIGS. 2 and 3, transport rollers 48 are disposed on an inlet side, an outlet side and inside of the drying devices 22 so as to convey the web 12 at a predetermined conveyance speed.

An air feed duct 30 is provided on the inlet side of a drying device 22, and an exhaust duct 32 is provided on the outlet side. The air feed duct 30 and the exhaust duct 32 are provided with an air feed fan 56 and an exhaust fan 58, respectively, which are respectively rotated by inverter motors, not shown. The air feed fan 56 and the exhaust fan 58 blow air through the drying device 22.

Drying adjustment dampers 34 and 36 are provided in the air feed duct 30 and the exhaust duct 32, respectively, and the volume of air blown through the drying device 22 can be adjusted by opening or closing the dampers accordingly.

A plurality of infrared radiators 38 are disposed on an upper portion of the drying device 22 along a widthwise direction of the web 12 so as to heat the web 12 conveyed through the drying device 22. The infrared radiators 38 have a cylindrical shape, use quartz glass as an emitter for infrared rays, and have a maximum energy wavelength of 2 μm and coil temperature of about 1200° C.

A filter 40 formed by quartz glass is disposed between the infrared radiators 38 and the conveyed web 12. The separation distance L (mm) between the filter 40 and the infrared radiators 38 satisfies a relationship $0<L\leqq 100$, and the filter 40 is of a thickness that can block at least 30% of wavelengths in a range of 1 μm or less, among the wavelengths output from the infrared radiators 38 (blocking rate differing according to thickness).

The function of the drying device according to the embodiment of the invention will be described below.

As shown in FIGS. 2 and 3, in the invention, the filter 40, which blocks 30% or more of wavelengths in a range of 1 μm or less, is arranged between the conveyed web 12 and the infrared radiators 38. That is to say, infrared rays emitted from the infrared radiators 38 irradiate the conveyed web 12 after being filtered by the filter 40.

The infrared rays have a wavelength range of about 0.76 μm to 1 mm, and the wavelength range is divided into a near-infrared range (0.76 to 2 μm), a mid-infrared range (2 to 4 μm), and a far-infrared range (4 μm to 1 mm). As the wavelength range becomes shorter, heating efficiency improves.

When the photosensitive coating layer 12A on the web 12 is dried, if the web 12 is heated in a low-wavelength range with good heating efficiency, the photosensitive coating layer 12A on the web 12 becomes fogged. On the other hand, if the web 12 is heated in a high-wavelength range, the heating efficiency is not satisfactory and production efficiency deteriorates.

The filter 40 is, however, arranged between the conveyed web 12 and the infrared radiators 38 (the maximum energy wavelength of which is 2 μm as mentioned above) so as to block 30% or more of wavelengths of 1 μm or less, thereby preventing fogging on the photosensitive coating layer 12A and achieving high heating efficiency.

In the present embodiment, the filter 40 is formed by quartz glass, but may be formed by ceramic material, or glass may be coated with a film or the like that can block a predetermined range of wavelength.

The infrared radiators 38 in the present embodiment use quartz glass as the emitter for infrared rays, and have a maximum energy wavelength of 2 μm and a coil temperature of about 1200° C. The infrared radiators 38 are not, however, limited to these specifications.

For example, infrared radiators may use ceramic material as the emitter for infrared rays. In this case, gas type or electric type infrared radiators in which the ceramic material can be heated to a sufficiently high temperature are suitable. Further, the infrared radiators may have a panel shape.

In this embodiment, the infrared radiators 38 are disposed above the conveyed web 12, but may of course be disposed below the conveyed web 12. However, it is not necessary to arrange the filter 40 between the infrared radiators 38 and the conveyed web 12 when the infrared radiators 38 are disposed below the web 12.

Examples of a support medium include a plate-shaped body with stable strength such as paper, paper laminated with plastic (for example, polyethylene, polypropylene, or polystyrene), a metal plate (for example, aluminum, zinc, or copper), plastic film (for example, cellulose diacetate, cellulose triacetate, cellulose propionate, cellulose butyrate, cellulose acetate butyrate, cellulose nitrate, polyethylene terephthalate, polyethylene, polystyrene, polypropylene, polycarbonate, or polyvinyl acetal), and paper or plastic film laminated or deposited with the above metals.

As the support medium of the invention, a polyester film or an aluminum plate is preferable, and the aluminum plate is particularly preferable because it has good dimensional stability and is comparatively inexpensive. Preferable aluminum plates are a pure-aluminum plate or an alloy plate that mainly contains aluminum and also contains a small quantity of different elements. Further, a plastic film laminated or deposited with aluminum may be used. Examples of the different elements in the aluminum alloy include silicon, iron, manganese, copper, magnesium, chromium, zinc, bismuth, nickel, and titanium. The content of the different elements in the alloy is at the most not more than 10% by weight.

The aluminum particularly preferable for use in the invention is pure aluminum, but since it is difficult to production completely pure aluminum from the viewpoint of refining techniques, the aluminum may contain traces of different elements. The thickness of the aluminum plate to be used in the invention is about 0.1 mm to 0.6 mm, preferably 0.15 mm to 0.4 mm, and particularly preferably 0.2 mm to 0.3 mm. The web 12 used in this embodiment is wound into a roll shape, but it is not always necessary that the web 12 can run continuously.

The photosensitive coating layer 12A is of an organic solvent type having photosensitivity or thermosensitivity. Specific examples of the photosensitive coating layer include photosensitive coating layers as used in a conventional positive printing plate having a photosensitive coating layer mainly containing naphthoquinonediazido and phenolic resin, a conventional negative printing plate having a photosensitive coating layer mainly containing diazonium salts and alkaline resin or urethane resin, a photopolymer digital direct printing plate having a photosensitive coating layer composed of ethylenic unsaturated compound, photopolymeric initiator and binder resin, a thermal positive digital direct printing plate having a photosensitive coating layer mainly containing phenolic resin, acrylic resin and IR dye, or a thermal negative digital direct printing plate having a photosensitive coating layer composed of thermal acid generator, thermal crosslinker, reactive polymer and IR dye. Further examples include organic solvent type photosensitive coating layers used in a thermal abrasion unprocessed printing plate, a thermal heat-fusion unprocessed printing plate, and a planographic printing plate using a silver salt diffusion transfer method.

Examples of the organic solvent include, but are not limited to, ethylene dichloride, cyclohexanone, methyl ethyl ketone, methanol, ethanol, propanol, ethylene glycol monomethyl ether, 1-methoxy-2-propanol, 2-methoxyethyl acetate, 1-methoxy-2-propyl acetate, dimethoxyethane, methyl lactate, ethyl lactate, N,N-dimethylacetamide, N,N-dimethylform-amide, tetramethylurea, N-methylpyrolidone, dimethyl sulfoxide, sulfolane, γ-butyrolactone, toluene acid.

These solvents are used independently or are mixed, and the density of the above component (total solid including additives) in the solvent is preferably 1 to 50 wt %. Application quantity on the support medium (solid) obtained after coating and drying differs according to applications, but generally 0.5 to 5.0 g/m$^2$ is preferable for the photosensitive printing plate.

EXAMPLE

The surface of the web 12, which is a belt-shaped aluminum plate, is subject to a mechanical surface roughening process, a chemical etching process, an electrolytic surface roughening process, and an anodizing process. As a result, a substrate whose average surface roughness Ra is 0.48 μm is prepared. A positive planographic printing plate coating liquid is applied to the web 12 and is dried.

Table 1 shows the influence of the respective absence or presence of the filter 40 shown in FIGS. 2 and 3 upon the photosensitive coating layer 12A.

TABLE 1

| | Without filter | | With filter | |
|---|---|---|---|---|
| Blocking rate of wavelengths of not more than 1 μm | — | — | Not less than 25% | not less than 30% |
| Separation distance between infrared radiators and filter | — | — | 10 mm | 10 mm |
| Surface temperature of infrared radiators | 1000° C. mid-infrared rays | 200° C. far-infrared rays | 1000° C. mid-infrared rays | 1000° C. mid-infrared rays |
| Occurrence/non-occurrence of fogging | Present on entire surface | None | Present on part of surface | None |
| Drying time | 8 seconds | 18 seconds | 10 seconds | 12 seconds |

According to Table 1, in the case of the infrared radiator for mid-infrared rays, the surface temperature of the infrared radiator is 1000° C. and the drying time required for drying the photosensitive coating layer 12A is only 8 seconds. However, the entire surface of the photosensitive coating layer 12A is fogged.

However, in the case of the infrared radiator for far-infrared rays, the photosensitive coating layer 12A is not fogged, but the surface temperature of the infrared radiator is 200° C. For this reason, the drying time is 18 seconds, and thus the production efficiency is reduced.

On the other hand, in the latter two cases in Table 1, the filter is arranged in a position separated by 10 mm from the infrared radiators so as to block the low-wavelength range of 1 μm or less. In these cases, when a filter 40 which can block 25% or more of the low-range wavelength of 1 μm or less is used for infrared radiators for mid-infrared rays, the drying time is 10 seconds but the photosensitive coating layer 12A is partially fogged.

However, when a filter 40 which can block 30% or more of the low-range wavelength of 1 μm or less is used for infrared radiators for mid-infrared rays, the photosensitive coating layer 12A is not fogged. The drying time is 12 seconds, and thus the production efficiency is not greatly influenced.

The use of a filter 40 which blocks 30% or more of wavelengths of 1 μm or less can prevent fogging on the photosensitive coating layer 12A and provide high heating efficiency.

What is claimed is:

1. A drying device that dries a photosensitive layer of a photosensitive planographic printing plate using infrared rays, comprising:

an infrared emitting device; and a filter that is arranged between the infrared emitting device and the photosensitive planographic printing plate as conveyed through the drying device and that blocks a predetermined range of wavelength, and wherein a separation distance L (mm) between the filter and the infrared emitting device satisfies a relationship $0<L\leqq 100$.

2. A drying device according to claim 1, wherein the filter blocks wavelength in a range of 1 μm or less.

3. A drying device according to claim 2, wherein a blocking ratio of the wavelength in a range of 1 μm or less by means of the filter is 30% or more.

4. A drying device according to claim 1, wherein the filter is quartz glass.

5. A drying device according to claim 1, wherein the filter is ceramic.

6. A drying device according to claim 1, wherein a maximum energy wavelength of the infrared emitting device is within a mid-infrared range (2 to 4 μm).

7. A drying device according to claim 1, wherein the filter is formed by coating glass with a film that can block wavelength in the predetermined range.

8. A drying device that dries a photosensitive layer of a photosensitive planographic printing plate using infrared rays, comprising:

an infrared emitting device; and a filter that is arranged so as to be separated by a predetermined distance from the infrared emitting device and that intercepts infrared rays emitted from the infrared emitting device to the photosensitive planographic printing plate as conveyed through the drying device, wherein the filter blocks wavelength in a predetermined range, of the infrared rays, and wherein a separation distance between the filter and the infrared emitting device is 100 mm or less.

9. A drying device according to claim 8, wherein the filter blocks wavelength in a range of 1 μm or less.

10. A drying device according to claim 9, wherein a blocking ratio of the wavelength in a range of 1 μm or less by means of the filter is 30% or more.

11. A drying device according to claim 8, wherein the filter is quartz glass.

12. A drying device according to claim 8, wherein the filter is ceramic.

13. A drying device according to claim 8, wherein a maximum energy wavelength of the infrared emitting device is within a mid-infrared range (2 to 4 μm).

14. A drying device according to claim 8, wherein the filter is formed by coating glass with a film that can block wavelength in the predetermined range.

15. A drying method for drying a photosensitive layer of a photosensitive planographic printing plate using infrared rays, comprising:

drying the photosensitive layer using a drying device in which a filter that blocks wavelength in a predetermined range is arranged between the photosensitive planographic printing plate as conveyed through the drying device and an infrared emitting device; and separating the filter and the infrared emitting device by a distance L (mm), where $0<L\leqq 100$.

16. A drying method for drying a photosensitive layer of a photosensitive planographic printing plate using infrared rays, comprising:

emitting, from an infrared emitting device, infrared rays whose maximum energy wavelength is within a mid-infrared range (2 to 4 μm) via a filter to the photosensitive planographic printing plate as conveyed through a drying device so as to dry the photosensitive layer, wherein the filter blocks wavelength in a predetermined range, of the infrared rays, and separating the filter and the emitting device by a distance of 100 mm or less.

17. A drying method according to claim 16, wherein the filter blocks wavelength in a range of 1 μm or less.

18. A drying method according to claim 16, wherein a blocking rate of the wavelength in a range of 1 μm or less by means of the filter is 30% or more.

* * * * *